United States Patent [19]

Killian

[11] 4,187,826

[45] Feb. 12, 1980

[54] FOLDING LIMB COMPOUND ARCHERY BOW

[76] Inventor: Gerald I. Killian, 16016 SE. 82nd Dr., Clackamas, Oreg. 97015

[21] Appl. No.: 787,860

[22] Filed: Apr. 15, 1977

[51] Int. Cl.[2] ..... F41B 5/00

[52] U.S. Cl. ..... 124/24 R; 29/235; 124/88

[58] Field of Search ..... 124/23 R, 24 R, 90, 124/88, 86; 403/12; 24/122.6, 135 N, 135 R; 29/235

[56] References Cited

U.S. PATENT DOCUMENTS

| | | | |
|---|---|---|---|
| 3,207,145 | 9/1965 | Browning et al. | 124/23 R |
| 3,253,587 | 5/1966 | Pearson | 124/23 R |
| 3,294,078 | 12/1966 | Allen | 124/23 R |
| 3,352,296 | 11/1967 | Burger | 124/23 R |
| 3,486,495 | 12/1969 | Allen | 124/24 R |
| 3,841,295 | 10/1974 | Hunter | 124/24 R |
| 3,957,027 | 5/1976 | Drake | 124/23 R |
| 4,050,137 | 9/1977 | Carlson | 29/235 |

FOREIGN PATENT DOCUMENTS

| | | | |
|---|---|---|---|
| 708863 | 7/1941 | Fed. Rep. of Germany | 24/122.6 |

*Primary Examiner*—Richard C. Pinkham

*Assistant Examiner*—William R. Browne

*Attorney, Agent, or Firm*—James E. Nilles

[57] ABSTRACT

A compound archery bow has resilient limbs pivotally attached to the opposite ends of a central handle by hinges allowing the limbs to be folded between an operative position and a folded position. The limbs are releasably secured in an operation position by a latch mechanism. A secondary cable interconnects each limb and a tensioning lever on the handle for adjustably pre-tensioning the limbs. A ratchet shaft assembly pivotally mounts the tensioning levers and allows the tension of each limb to be adjusted. The limbs can be relaxed by lengthening a stringer, whereupon the latch mechanism can be opened, allowing the limbs to be released and pivoted on the hinges to their folded position adjacent the belly side of the bow. Cam members are mounted at the outer end of each limb and around which the end segments of the bow string are wrapped at least about 270° in each direction. Thus the cam members can be reversibly rotated to accommodate either tensioning of the bow for projecting an arrow, or relaxing of the bow for release of the limbs. As a result the bow may be folded and unfolded without altering its pre-established tension characteristics.

9 Claims, 12 Drawing Figures

FOLDING LIMB COMPOUND ARCHERY BOW

BACKGROUND OF THE INVENTION

This invention relates to compound archery bows, and more particularly to a compound archery bow which is foldable to a compact unit for transportation or storage.

Compound archery bows have come into wide use for both target and game shooting. Their principal advantage resides in the reduction of pull weight at full draw, whereby an archery may utilize a pull weight greater than his normal abilities, while simultaneously affording greater sighting control.

However, like most archery bows, compound archery bows are quite large and cumbersome, making them difficult to transport or store. Although the limbs of many of the prior art compound bows are pivotable, for tension adjustments, to do so in order to allow folding of the limbs, obviously destroys any such pre-tensioning adjustment. Moreover, the limbs cannot be relaxed merely by removing the working stretch of the bow string, because the end segments of the bow string which are attached to the cams are not wrapped around the cams sufficiently to allow the cams to rotate enough to relax the limbs. Accordingly, pivoting of the limbs, and loss of pre-tensioning, is necessary to effect folding of the prior art compound bows.

On the other hand, the compound bow described in U.S. Pat. No. 3,841,295 provides for pre-tensioning of the limbs by secondary cables adjustably interconnecting the limbs and handle. Accordingly, the pivotal attachment of the limbs to the handle might be utilized for folding the limbs, except for the fact that the connection of the end segments of the bow string to the cams at the outer ends of the limbs does not allow the cams to rotate sufficiently to extend the end segments far enough to achieve the required relaxation of the limbs preliminary to release of the limbs for folding.

SUMMARY OF THE INVENTION

In its basic concept, the compound archery bow of this invention involves joining the limbs to the handle by means of hinges which allow folding of the limbs to a compact orientation and wrapping the bow string end segments about eccentric cams at the outer ends of the limbs sufficiently to allow relaxing of the limbs before folding.

It is by virtue of the foregoing basic concept that the principal objective of this invention is achieved; namely, to overcome the aforementioned disadvantages and limitations of prior compound bows.

Another important object of this invention is the provision of a compound archery bow of the class described having means for enabling disconnection of the working stretch of the bow string from one of its end segments for facilitating folding of the limbs.

A further object of this invention is the provision of a compound archery bow of the class described wherein the cam located at the end of each limb, over which each bow string end segment is trained, is designed to rotate sufficiently to achieve complete relaxation of the limbs preliminary to folding.

A further object of this invention is the provision of a compound archery bow of the class described having clamp means for clamping the bow string and secondary cables together to prevent their becoming tangled and the end segments from being disengaged from the cams when the bow is folded.

A still further object of this invention is the provision of a compound archery bow of the class described having locking type ratchet winches configured for easy adjustment of secondary cables which are used for adjusting the pre-tension of the limbs, and for locking the adjustment during shooting and folding of the limbs.

A still further object of this invention is the provision of a compound archery bow of the class described which is of simplified construction for economical manufacture.

The foregoing and other objects and advantages of this invention will appear from the following detailed description, taken in connection with the accompanying drawings of a preferred embodiment.

DESCRIPTION OF THE PREFERRED EMBODIMENT

Figure 1:
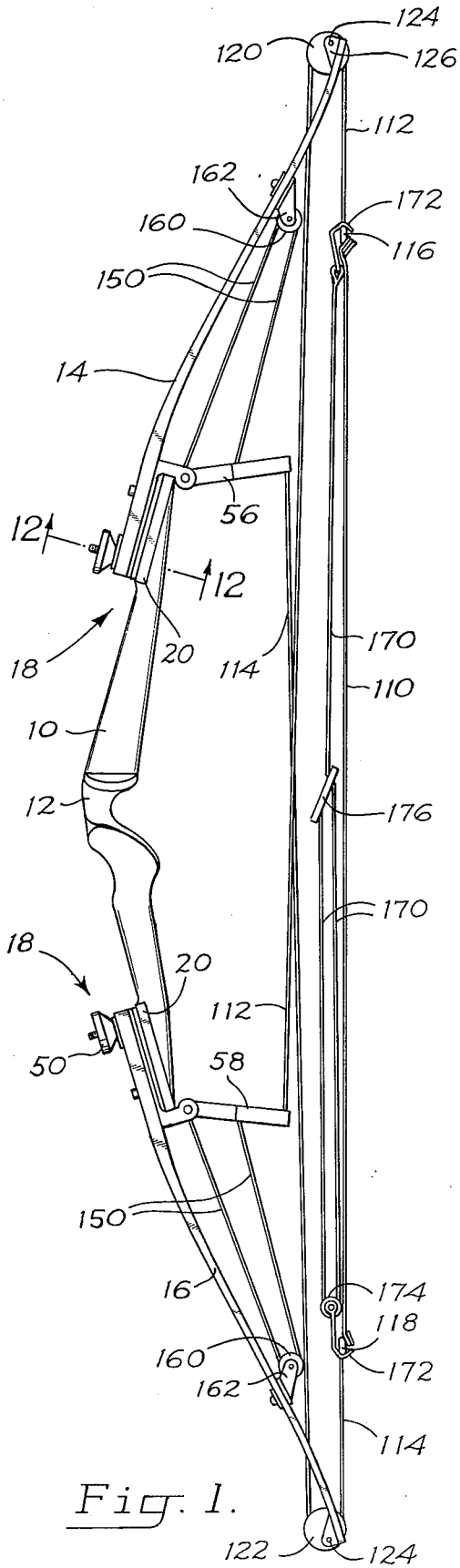
FIG. 1 is a view in side elevation of an archery bow embodying the features of this invention, the bow being shown in normal, un-drawn condition but with the stringer installed in preparation of folding.
Figure 4:
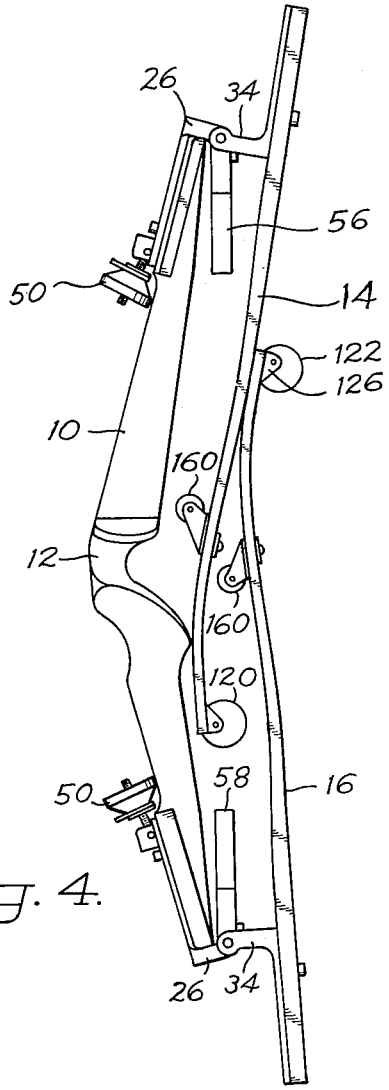
FIG. 4 is a view in side elevation showing the bow in its folded position, with the bow string, stringer and cables removed for clarity.

Referring to FIG. 1 of the drawings, the bow of the present invention includes a central handle 10 provided with a medial hand grip 12. A pair of resilient limbs 14 and 16 extend outwardly from the opposite ends of the handle. The limbs are joined pivotally to the handle by means of hinges 18. Thus, the limbs may be rotated from operative positions, extending outwardly of the handle, FIG. 1, to folded positions inwardly adjacent to the handle, FIG. 4.

Figures 8, 9, 10, 11, 12:
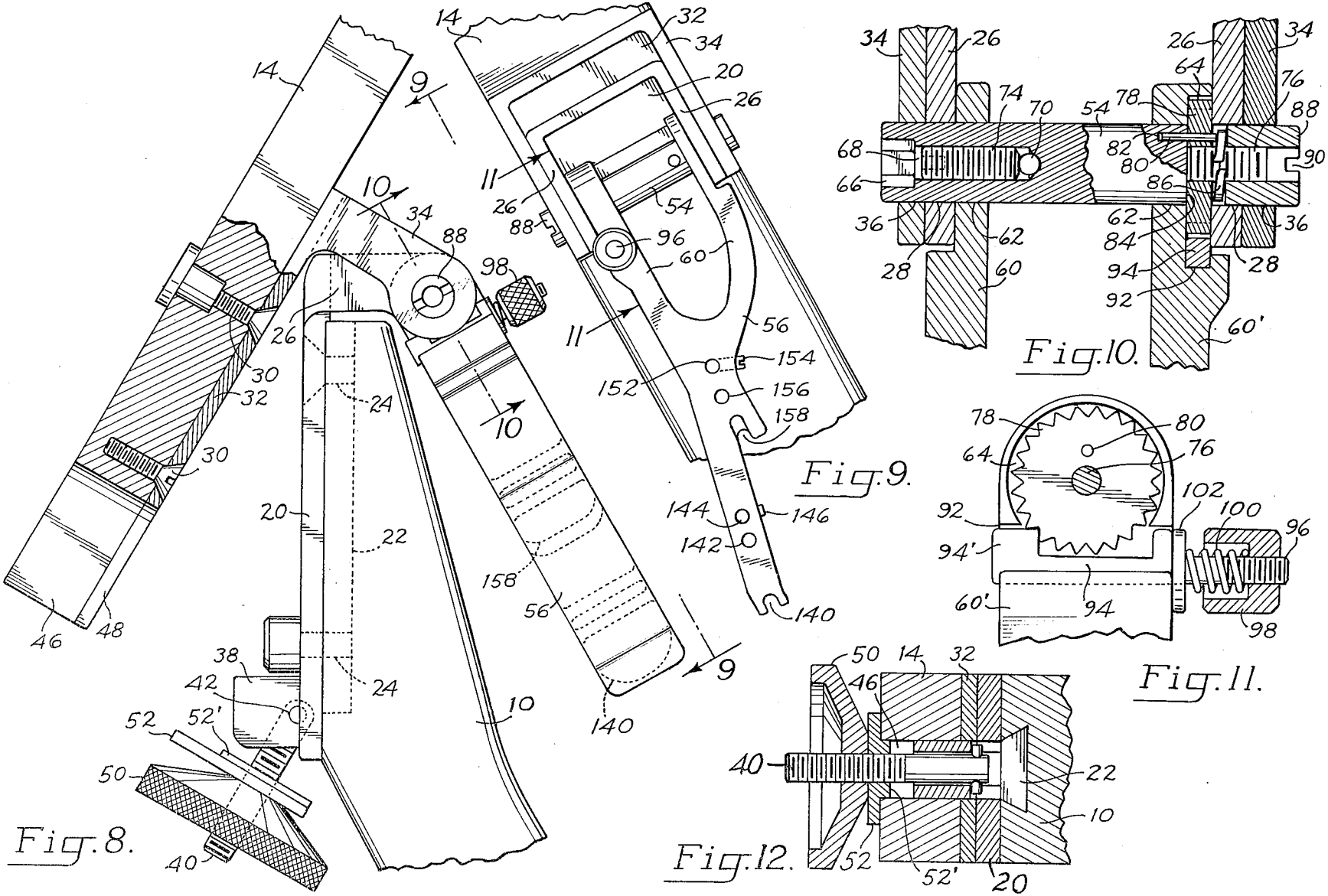
FIG. 8 is a fragmentary detail view, partially broken away and at an enlarged scale, showing one of the hinges which interconnect the limbs and the handle, the hinge being shown in unlatched position.
FIG. 9 is a fragmentary plan view taken on the line 9—9 in FIG. 8.
FIG. 10 is a fragmentary sectional view taken on the line 10—10 in FIG. 8.
FIG. 11 is a fragmentary sectional view taken on the line 11—11 in FIG. 9.
FIG. 12 is a fragmentary sectional view taken on the line 12—12 in FIG. 1.

As best shown in FIGS. 8 and 12, each hinge comprises a stationary mounting plate 20. The mounting plate is fixed to the forward surface of its associated end of the handle by means, such as a dove tail attachment plate 22 which is received within a dove tail slot located in the handle. Threaded fasteners 24 fit through openings in the mounting plate and into engagement with threaded bores in the attachment plate for clamping the hinge to the handle.

Located at the outer end of the mounting plate 20 are spaced apart paired tabs 26 each having a terminal end provided with a medial bore 28 (FIG. 10). The tabs extend rearwardly from the mounting plate across the end of the handle, with the terminal ends located on the side of the handle opposite the mounting plate.

Mounted on the rear surface of the inner extremity of each limb 14 and 16, by means of fasteners 30, is a hinge plate 32 having readwardly facing paired tabs 34 located at its outer end. The tabs are spaced apart a distance to fit outwardly of tabs 26, and they have medial bores 36 located at their outer ends.

Mounted on the inner portion of the mounting plate 20 are bifurcated lugs 38 which mount a threaded stud 40 pivotally therebetween by means of a pin 42. The ends of the limb and the hinge plate contain notches 46 and 48, respectively, which are configured for passing the studs and lugs when the bow is in its operative position.

Latching means, such as a threaded knob 50, is screwed onto the stud for securing the limb in its operative position, and a clamping plate 52 fits over the stud between the knob and limb. An inner portion 52' of the clamping plate is dimensioned to enter the notch 46 to prevent rotation of the plate (FIG. 12).

Pivotally mounted at the opposite ends of the handle 10, on a shaft 54 extending between the ends of tabs 26, are elongated levers 56 and 58. The levers have bifurcated legs 60 at one end provided with aligned bores 62 which have the same diameter as bores 28 and 36. One of the legs 60' is larger than the other and contains a counter-bore 64 which is coaxial with bore 62.

One end of the shaft 54 has a hexagonal recess 66 (FIG. 10) arranged for receiving an Allen wrench. The inner end of the recess terminates at a threaded bore 68 which extends inwardly of the leg 60. A passageway 70 extending transversely through the shaft intersects the inner end of bore 68 so that a cable 150 (FIG. 10) passing through the passageway can be secured to the shaft by a set screw 74 threaded into the bore.

The other end of the shaft 54 has a threaded section 76 of reduced diameter. A ratchet gear 78 fits freely on this threaded section and is received in counterbore 64. A lock pin 80 projects inwardly of ratchet gear 78 into a socket 82 in the shoulder 84 formed between the enlarged portion of the shaft 54 and the threaded end section 76, whereby to secure the gear against rotation relative to the shaft.

A lock washer 86 is interposed between the outer side of the ratchet gear 78 and a securing nut 88. The latter preferably is provided with a screw driver slot 90 for convenience of manipulation.

A groove 92 is formed in leg 60' to intercept the counterbore 64 tangentially (FIG. 11). A C-shaped ratchet dog 94 slidably fits within groove 92 in a manner for releasably engaging the ratchet gear 78. The dog has a threaded extension 96 which projects outwardly of leg 60' and receives a dog latching nut 98. A spring 100 fits between nut 98 and a washer 102 abutting the leg 60', normally urging the pawl end 94' of the dog into contact with the ratchet gear 78. Thus the shaft 54 is able to rotate in one direction, clockwise in FIG. 11, and not in the opposite direction. However, by pressing the dog inwardly the pawl 94' is moved out of contact with the ratchet gear, allowing the shaft to rotate freely in either direction.

The bow includes a string by which an arrow is projected. In the embodiment illustrated the string includes an elongated intermediate working stretch 110 and a pair of opposite end segments 112 and 114 which are connected detachably to the opposite ends of the working stretch by couplings 116 and 118 respectively. The end segments 112 and 114 are trained about cam members 120 and 122, respectively, which are mounted at the outer ends of the limbs 14 and 16. Each cam member is mounted eccentrically by a pin 124 which is carried in a bracket 126 mounted on the limb.

Figure 5:
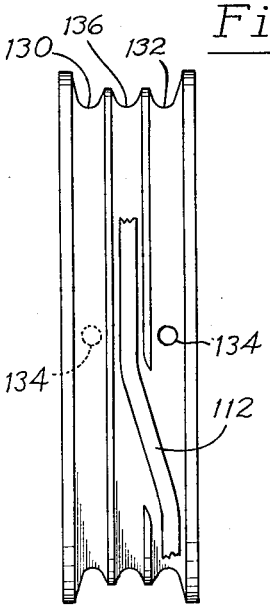
FIG. 5 is a plan view of the upper eccentric cam member as viewed from the top in FIG. 1, showing the path of wrapping of a portion of the associated bow string end segment.
Figure 6:
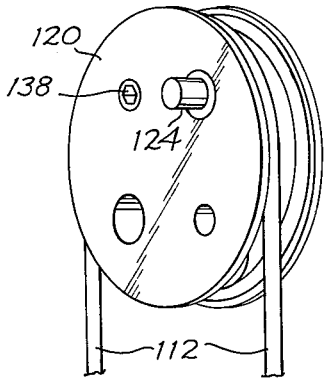
FIG. 6 is a fragmentary perspective view showing the orientation of the bow string end segment as it is trained around and through the cam member shown at the top in FIG. 1, the same being shown as viewed from the right in FIG. 1.
Figure 7:
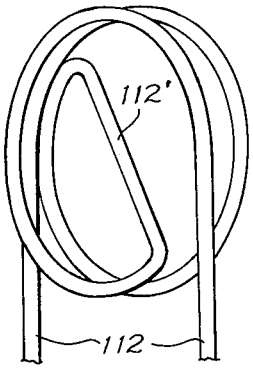
FIG. 7 is a fragmentary perspective view showing only the bow string end segment as it is trained about the cam member of FIG. 6.

In the preferred embodiment, best illustrated in FIGS. 5–7, each cam member includes a circular pulley having a pair of circumferential outer guide grooves 130 and 132 and an interconnecting diametric bore 134, and an intermediate groove 136. In the normal condition of the bow (FIG. 1), the end segment 112 leading from the working stretch 110 is trained about guide groove 130 counterclockwise (FIGS. 6 and 7) for approximately 360°, and is then inserted into one end, the left hand end in FIG. 5, of bore 134. The portion 112' (FIG. 7) of the end segment extending through the bore is secured releasably therein by means of a set screw 138 (FIG. 6). The end segment 112 leading outwardly from the bore 134, the right hand end in FIG. 5, then is wrapped counterclockwise about guide groove 132 for approximately 360°. Then it is passed inward to the central groove 136, through a gap between the grooves 132 and 136 (FIG. 5), and then is wrapped about 45° counterclockwise about groove 136 and extended to connection to lever 58. The end segment makes a S-shaped loop about the end of the lever 58 over a notch 140 (FIG. 9), through bore 142 and thence back through bore 144 where it is secured by means of a set screw 146.

The end segment 114 at the opposite end of the bow is wrapped in similar manner about cam 122, to which it also is secured by a set screw 138. It then extends to lever 56 where it is secured by means of set screw 146.

By the foregoing arrangement of wrappings, the cams may be rotated about 270° from the normal condition of the bow to full draw, with consequent increasing the tension in the limbs, and about 270° in the opposite direction from the normal condition of the bow. This allows the working stretch to be uncoupled from one end segment and the limbs to be relaxed, prior to folding, without removal of the end segments from the cams.

Pre-tensioning of the bow limbs 14 and 16 is provided by elongated secondary tensioning cables 150 which connect the levers 56 and 58 to their respective limbs 14 and 16. One end of each cable fits into a bore 152 (FIG. 9) which is located intermediate the ends of the lever where it is secured by set screw 154. The cable then makes an S-bend through bore 156, over notch 158 and then extends outwardly to an intermediate point on the associated limb. There it is trained over a pulley 160 which is attached by bracket 162 to the bow limb and extends back, inwardly, to the ratchet-operated shaft 54. The other end of the secondary cable then passes through passageway 70 in the shaft (FIG. 10) where it is secured by set screw 74. Thus, each limb can be adjusted for flexure and tension independently of the other by selective operation of the ratchet, by an Allen wrench applied to the socket 66, after nut 98 has been loosened.

Figure 2:
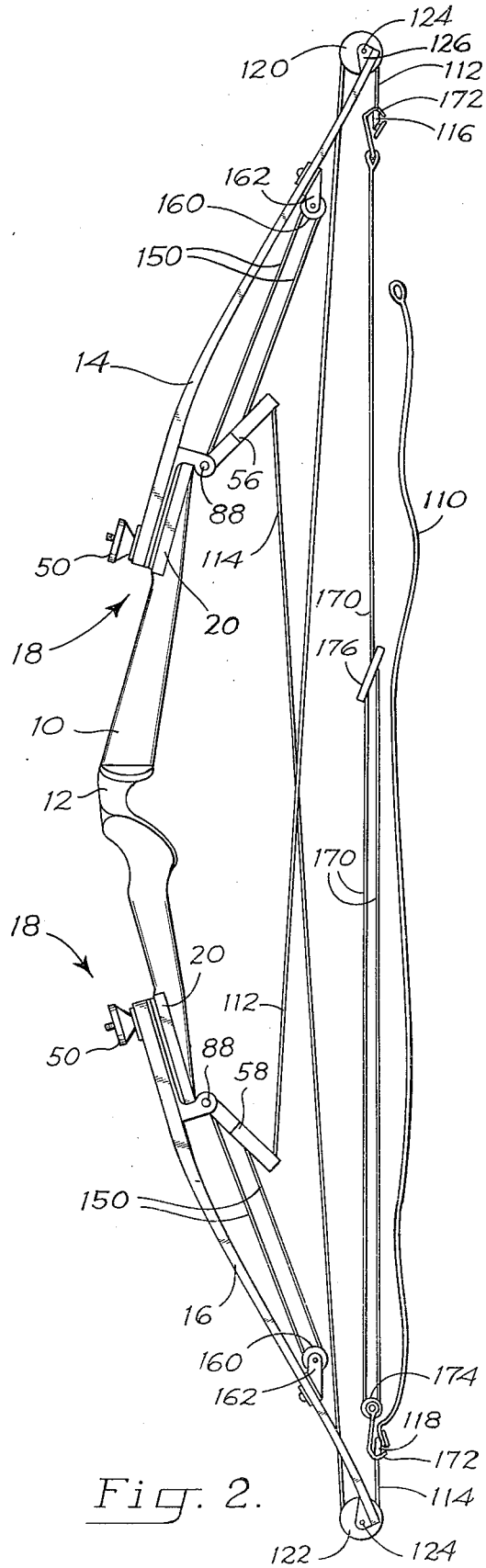
FIG. 2 is a view in side elevation showing the bow of FIG. 1 with the stringer lengthened to completely relax the limbs, preliminary to folding.

In the normal condition of the bow, the working stretch 110 is tensioned to a degree along with the limbs 14 and 16. In order to fold the limbs, it is necessary first to uncouple the working stretch in order to relieve all tension on the limbs so that the hinges 18 may be opened. For this purpose, a stringer 170 is provided for connection between the opposite end segments 112 and 114, coextensive with the working stretch 110, providing an adjustable length replacement for the working stretch. As best illustrated in FIGS. 1 and 2, the stringer comprises an elongated cable having a bifurcated hook coupler 172 located at each end which is configured for releasable joinder with couplings 116 and 118 of the end segments 112 and 114.

The cable 170 is trained intermediate its ends through a pulley 174 connected pivotally to one of the end segment couplings, preferably to the bottom coupling 118 of end segment 114. After being reversely bent around pulley 174, one end of the cable is attached to one end of a slide handle 176. The slide handle includes an opening at its other end arranged to receive the cable in a sliding fashion at a point intermediate pulley 174 and top coupling 116. Thus, by sliding the slide handle along the cable, the effective length of the stringer is altered. However, when the stringer is placed in tension, by application of opposed forces on couplings 116 and 118, the slide handle is displaced angularly, crimping the cable and thus preventing lengthening of the stringer.

In operation, the bow is set up with the limbs 14 and 16 secured in their operative positions by knobs 50 which are tightened on studs 40. The bow is pre-tensioned in the conventional manner by means of the ratchet assembly associated with shaft 54. Thus, to increase the tension of a limb, nut 98 is loosened and an Allen wrench is inserted in the appropriate recess 66 and rotated clockwise (FIG. 11). The ratchet gear 78 is arranged for engagement by dog 94' in a manner which permits clockwise rotation of the gear but prevents its counterclockwise rotation. Thus, the associated cable 150 may be wound onto the axle shaft 54 without subsequently unwinding. If it is desired to release the tension, however, the dog may be moved out of engagement with the ratchet by first loosening and then pushing nut 98 inwardly against the resistance of spring 100. When the bow is tensioned properly, the nut 98 is tightened to lock the adjustment. The limbs are flexed slightly to the position shown in FIG. 1.

To collapse the bow to its folded position, stringer 170 is installed between the opposite end segments 112 and 114 by attaching couplers 172 to the respective couplings 116 and 118. At this point the stringer is coextensive with the working stretch 110 and exerts no forces on the bow. The stringer is shortened by moving slide handle 176 along cable 170, upwardly in FIG. 1, further tensioning the limbs until the working stretch is slack. The working stretch then is uncoupled from one of the end segments, the upper one in FIG. 2, and the stringer then is lengthened until the limbs are relaxed.

It will be noted that the end segments of the bow string are wrapped around the cam members at least about 270° in both directions, as previously mentioned, and the working stretch couplings 116 and 118 are displaced from the cam members, at the normal rest position in FIG. 1 sufficiently to allow wrapping thereon of the adjacent portions of the end segments 112 and 114 while unwrappng the adjacent portions on the end segments at the other side of set screw 138. Accordingly, the tension of the bow limbs can be relaxed completely, as illustrated in FIG. 2.

Figure 3:
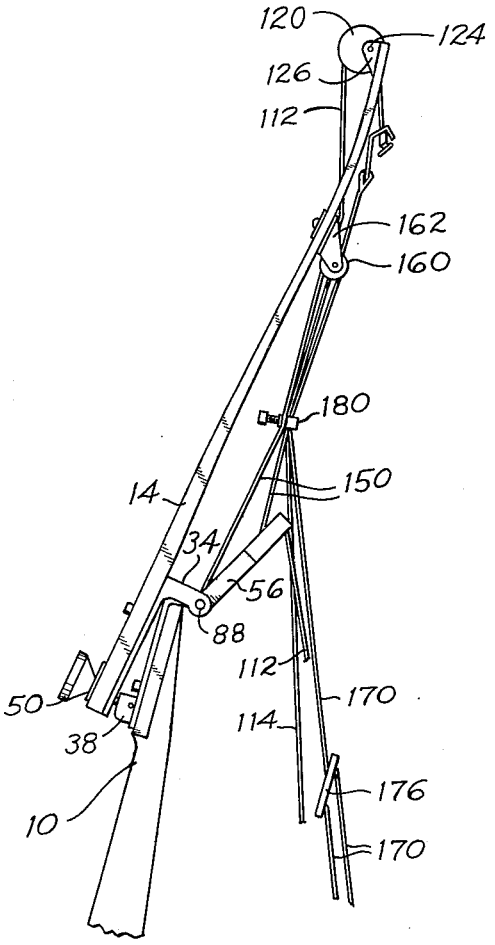
FIG. 3 is a fragmentary view in side elevation showing the means of securing the bow string, stringer and secondary tensioning cable preliminary to folding.

Knobs 50 then are loosened on studs (FIG. 3) allowing hinge 18 to open until the cables 150 relaxed. A clamp 180 then is placed over each of the seconary cables 150, the associated end segments 112 and 114 and the stringer cable 170 adjacent to each limb, and the clamp tightened to secure them all together. The stud 40 then is swung inwardly, as shown in FIG. 8, releasing the limbs and allowing them to be folded rearwardly and inwardly alongside handle 10 to the collapsed position shown in FIG. 4. The bow may now be transported easily or stored, preferably after placing it in a protective case.

When the bow is to be used again it is erected by reversing the procedure described. It will be appreciated that the tensioning controls need not be disturbed when the bow is folded. Thus, when it is erected again it remains in tune and does not require any adjustment before use. This is achieved by virtue of nut 98 having been tightened before folding of the limbs.

It will be apparent to those skilled in the art that various changes may be made in the size, shape, type, number and arrangement of parts described hereinbefore, without departing from the spirit of this invention.

I claim:

1. A compound archery bow comprising:

(a) a handle member, (b) a pair of bow limbs projecting from opposite ends of the handle member and terminating in a tip to receive a bow string, (c) a hinge means pivotally joining each limb to the handle in a manner allowing movement of the limbs between an operative position extending outwardly of the handle and a folded position inwardly adjacent of the handle wherein said tip lies on the same side of and adjacent to the belly of said handle member, (d) releasable latching means interengaging the handle and limbs for securing the limbs to the handle member releasably in their operative position, said latching means being quickly releasable for permitting said limbs to be folded about their respective hinge means to said folded position inwardly adjacent said handle, (e) a pair of cam members pivotally mounted eccentrically one adjacent the outer end of each limb, (f) a bow string for projecting an arrow, the bow string extending between the cam members and forming an intermediate working stretch and a pair of opposite end segments, (g) a pair of elongated levers mounted pivotally on the bow, each of the levers being positioned adjacent the inner end of its associated limb, the outer end of each lever being connected to the end segment of the bow string which is secured to the cam member on the opposite limb, and (h) a pair of secondary tension control cables each operatively interconnecting one of the limbs and its associated lever and adjustable for pretensioning the associated limb, (i) the cam members each having a diametric bore for receiving therethrough an intermediate portion of the associated bow string end segment, said end segment extending from each end of the bore being wrapped about the periphery of one of the cam members sufficiently to permit rotation of one of the cam members in one direction to full draw and in the opposite direction to relaxation of one of the limbs.

2. The archery bow of claim 1 including a stringer configured for engaging the opposite end segments of the bow string releasably coextensive with the working stretch and arranged for being shortened to permit removal of the working stretch and lengthened to permit the limbs to be relaxed.

3. The archery bow of claim 1 including a pair of clamps arranged for clamping together the secondary tension control cables, the bow string end segments and the stringer at points adjacent to each limb.

4. The archery bow of claim 1 wherein each bow string end segment is wrapped about the periphery of its associated cam member at least about 270° from each end of the diametric bore.

5. The archery bow of claim 1 wherein:

(a) each lever has a bifurcated inner end forming a pair of laterally spaced arms, (b) a pivot shaft extends through said spaced arms and is supported at its ends on the bow, (c) the portion of the shaft between the bifurcated arms forming a winch to which one end of the associated secondary tension cable is secured, (d) one of the arms having a first cavity therein registering with the shaft, (e) a ratchet gear in said first cavity is secured to the shaft for rotation therewith, (f) said one of said arms also having a second cavity therein tangent to and communicating with said first cavity, and (g) a ratchet arm is reciprocative in said second cavity tangent to the ratchet gear for releasable engagement with the latter.

6. A compound archery bow having a handle, a pair of bow limbs and a secondary tension control cable operatively interconnecting the handle and each limb, and further including (a) a lever having a bifurcated inner end forming a pair of laterally spaced arms, (b) a pivot shaft extending through said spaced arms and arranged for support at its opposite ends on said bow, (c) a portion of the shaft between said bifurcated arms forming a winch for said secondary tension control cable, (d) a first cavity in one of the spaced arms registering with the shaft, (e) a ratchet gear in said first cavity secured to the shaft for rotation therewith, (f) a second cavity in said spaced arm tangent to and communicating with said first cavity, and (g) a ratchet arm reciprocative in said second cavity tangent to the ratchet gear for releasable engagement with the latter.

7. A compound archery bow comprising:

(a) a handle member, (b) a pair of bow limbs projecting from opposite ends of the handle member and terminating in a tip to receive a bow string, (c) a hinge means pivotally joining each limb to the handle in a manner allowing movement of the limbs between an operative position extending outwardly of the handle and a folded position inwardly adjacent of the handle wherein said tip lies on the same side of and adjacent to the belly of said handle member, (d) releasable latching means interengaging the handle and limbs for securing the limbs to the handle member releasably in their operative position, said latching means being quickly releasable for permitting said limbs to be folded about their respective hinge means to said folded position inwardly adjacent said handle, (e) a pair of cam members pivotally mounted eccentrically one adjacent the outer end of each limb, (f) a bow string for projecting an arrow, the bow string extending between the cam members and forming an intermediate working stretch and a pair of opposite end segments each extending to operative connection to the opposite limb, (g) the cam members each having securing means for securing thereto an intermediate portion of the associated bow string and segment, said end segments extending in opposite directions from their respective securing means and each being wrapped about the periphery of their respective cam member sufficiently to permit rotation of the cam member in one direction to full draw and in the opposite direction to substantially full relaxation of the limb.

8. The archery bow of claim 7 including a stringer configured for engaging the opposite end segments of the bow string releasably coextensive with the working stretch and arranged for being shortened to permit removal of the working stretch and lengthened to permit the limbs to be relaxed.

9. The archery bow of claim 7 wherein each bow string end segment is wrapped about the periphery of its associated cam member at least about 270° in opposite directions from said securing means.

* * * * *